US005167411A

United States Patent [19]

Isobe

[11] Patent Number: 5,167,411

[45] Date of Patent: Dec. 1, 1992

[54] APPARATUS FOR CURRENCY VALIDATION

[75] Inventor: Atsushi Isobe, Kawasaki, Japan

[73] Assignee: Japan Cash Machine Co., Ltd., Osaka, Japan

[21] Appl. No.: 736,413

[22] Filed: Jul. 26, 1991

[30] Foreign Application Priority Data

Jul. 30, 1990 [JP] Japan ..... 2-79738[U]

[51] Int. Cl.[5] ..... B65H 5/02

[52] U.S. Cl. ..... 271/273

[58] Field of Search ..... 271/273, 177, 198, 314, 271/207; 194/206, 207

[56] References Cited

U.S. PATENT DOCUMENTS 4,050,562 9/1977 Schwippert et al. ..... 194/4
4,722,519 2/1988 Zouzoulas ..... 271/181
4,765,607 8/1988 Zouzoulas ..... 271/177
4,784,274 11/1988 Mori et al. ..... 271/273 X
4,834,230 5/1989 Kondo et al. ..... 194/206
4,880,096 11/1989 Kobayashi et al. ..... 194/206
5,014,857 5/1991 Kondo ..... 194/206 X

*Primary Examiner*—David H. Bollinger
*Attorney, Agent, or Firm*—Bachman & LaPointe

[57] ABSTRACT

An apparatus for currency validation is disclosed which comprises a validator for identifying authenticity of a bill and a stacker for storing bills. The validator includes a lower portion which has a fixing panel secured to an inner panel surface of a support, an upper portion in hinged connection to the lower portion for movement between opened and closed positions, and a belt-pulley arrangement for defining a passageway to guide a bill when the upper portion is in the closed position. The stacker is in hinged connection to the lower portion of the validator for rotation between operative and rest positions. The upper portion of the validator may be moved from the closed to the opened position after the stacker is moved from the operative to the rest position.

6 Claims, 4 Drawing Sheets

APPARATUS FOR CURRENCY VALIDATION

BACKGROUND OF THE INVENTION (a) Field of the Invention

The present invention relates, in general, to an apparatus for currency validation, and more specifically to an improvement of the apparatus for currency validation which has its structure to facilitate maintenance or inspection thereof.

(b) Description of the Prior Art

An apparatus for currency validation is equipped in a bill handling machine such as currency exchanging or vending machine installed indoor or outdoor. The machine comprises a validator for identifying authenticity of bills inserted therein and a stacker for storing accumulated bills considered authentic by the validator. In most of the bill handling machines, the validator is mounted in driving connection to the stacker and secured to an inner surface of a door panel of the machines so that bills may be received by the validator through an inlet formed in an fixing panel of the machine. Equipped with the validator is a belt-pulley arrangement for transporting the inserted bill through a position in the vicinity of a sensor to the stacker. The sensor comprises optical or magnetic detector which converts physical features of the bill into electric signals then forwarded to a central processing unit.

However, when creased or previously folded bills are put into the inlet of the validator, there are some cases where the belt-pulley arrangement fails to transport these bills to the stacker due to jamming thereof on the passageway through which the bills are conveyed. In particular, the bills are carried through different belt-pulley arrangements respectively mounted in the validator and stacker. Sometimes, the conveyed bill clogs at the transitional interconnection of these belt-pulley arrangements. Also, when an adhesive agent is attached to an inserted bill or inner surface of the passageway for bills within the validator, the bill is adhesively secured to the inner surface of the passageway or to the belt-pulley arrangement, and it is jammed or stopped to be transported. Once a bill is stuck or jammed on the passageway, the validator or stacker must be opened to remove the stuck or jammed bill therefrom.

In a prior art bill handling apparatus, the stacker is mounted below an underside of the validator so that the jammed bill can be removed from the passage after disassembling the validator and stacker. As shown in U.S. Pat. No. 4,050,562, a currency handling machine comprises a validator and a deposit container attached to an underside of the validator. However, in a recent bill handling apparatus, the stacker is mounted over the validator to reduce volume of occupation for the apparatus. U.S. Pat. Nos. 4,722,519 and 4,765,607 describe improved banknote stackers each of which includes upper and lower housings having molded fingers and slots for interconnection with a banknote validator, and banknote transport apparatus provided with a self adjusting belt-pulley arrangement. When the banknote is jammed on the way of transport by the belt-pulley arrangement, the machine must be disassembled to remove the jammed banknote. Accordingly, it is very difficult to readily remove the jammed bill from the passageway within the validator which can be disassembled after removal of the stacker mounted over the validator, and necessary parts must be disassembled in both of the validator and stacker, thus requiring time-consuming and burdensome operation.

SUMMARY OF THE INVENTION

Accordingly, it is an object of the present invention to provide an apparatus for currency validation that facilitates removal of a jammed bill.

Another object of the present invention is to provide an apparatus for currency validation which includes stacker means rotatable between operative and rest positions on validator means to readily remove a jammed bill.

Still another object of the present invention is to provide an apparatus for currency validation which may be attached to an inner surface of a door panel of a bill handling machine.

An apparatus for currency validation according to the present invention comprises validator means for identifying authenticity of a bill, the validator means including a lower portion which has an fixing panel secured to an inner panel surface of a support, an upper portion in hinged connection to the lower portion for movement between opened and closed positions, and a belt-pulley arrangement for defining a passageway to guide a bill when the upper portion is in the closed position; and stacker means provided in hinged connection to the lower portion of the validator means for rotation between operative and rest positions and for storing bills conveyed along the passageway by the belt-pulley arrangement of the validator means when the stacker means is in the operative position.

The upper portion of the validator means may be moved from the closed to the opened position after the stacker means is moved from the operative to the rest position. The apparatus further comprises hinge means which includes a pair of curved slots formed one of the upper and lower portions of the validator means, and pins secured to the other of the upper and lower portions in hinged connection with the slots for arcuate movement of a front end of the upper portion to the opened position. For instance, in the preferred embodiment of the invention, the upper portion of the validator means has the pins engaged with the curved slots formed at the lower portion of the validator. Alternatively, the lower portion of the validator means may have the pins engaged with the curved slots formed at the upper portion of the validator. The support is for example a door in pivoted connection to a casing of a bill exchanging or vending machine. The stacker means may be swiveled around shafts between the operative and rest positions on the lower portion of the validator means so that movement of the upper portion of the validator means is prevented when the stacker means is in the operative position. A lever is releasably engaged with a pin to keep the stacker means in the operative position.

When a bill is jammed on the passageway in the validator means, the door is opened and the stacker means is moved from the operative to the rest position. Then, the upper portion of the validator means is moved from the closed to the opened position with the arcuate movement of the front end of the upper portion along the curved slots of the hinge means. At the same time, the rear end of the upper portion is rotated to the opened position. Due to the arcuate movement of the front end, the upper portion may smoothly be moved to the opened position without contact of the front end with the fixing panel since the front portion is moved to its opened position away from the fixing panel. After the upper portion is moved to the opened position, the jammed bill may be removed from the passageway. Similar operations may be carried out for inspection or repair to the apparatus.

BRIEF DESCRIPTION OF THE DRAWINGS

A preferred embodiment of the present invention applied to a vending machine will be described with reference to the accompanying drawings in which.

Figure 1:
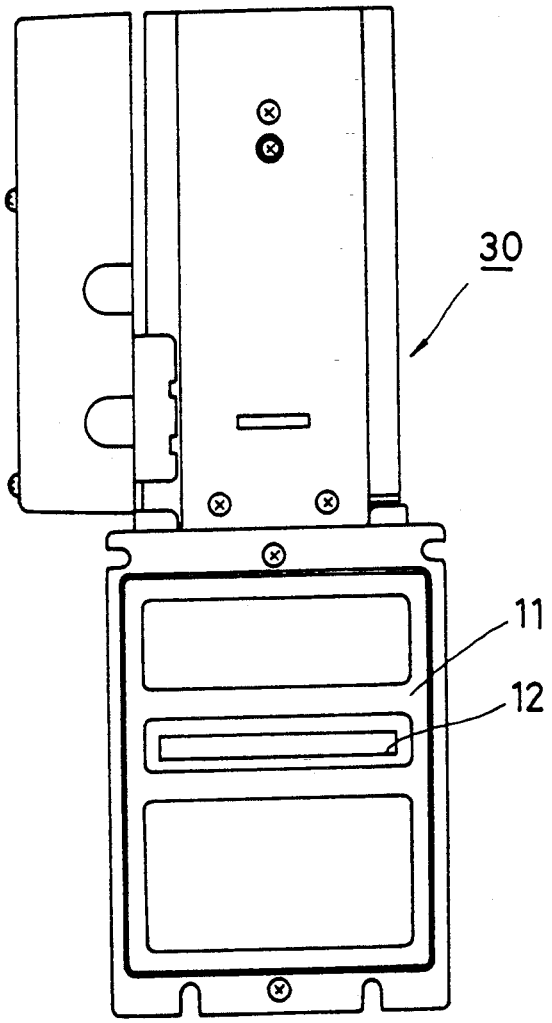
FIG. 1 is an elevation view of the apparatus for currency validation according to the present invention.
Figure 2:
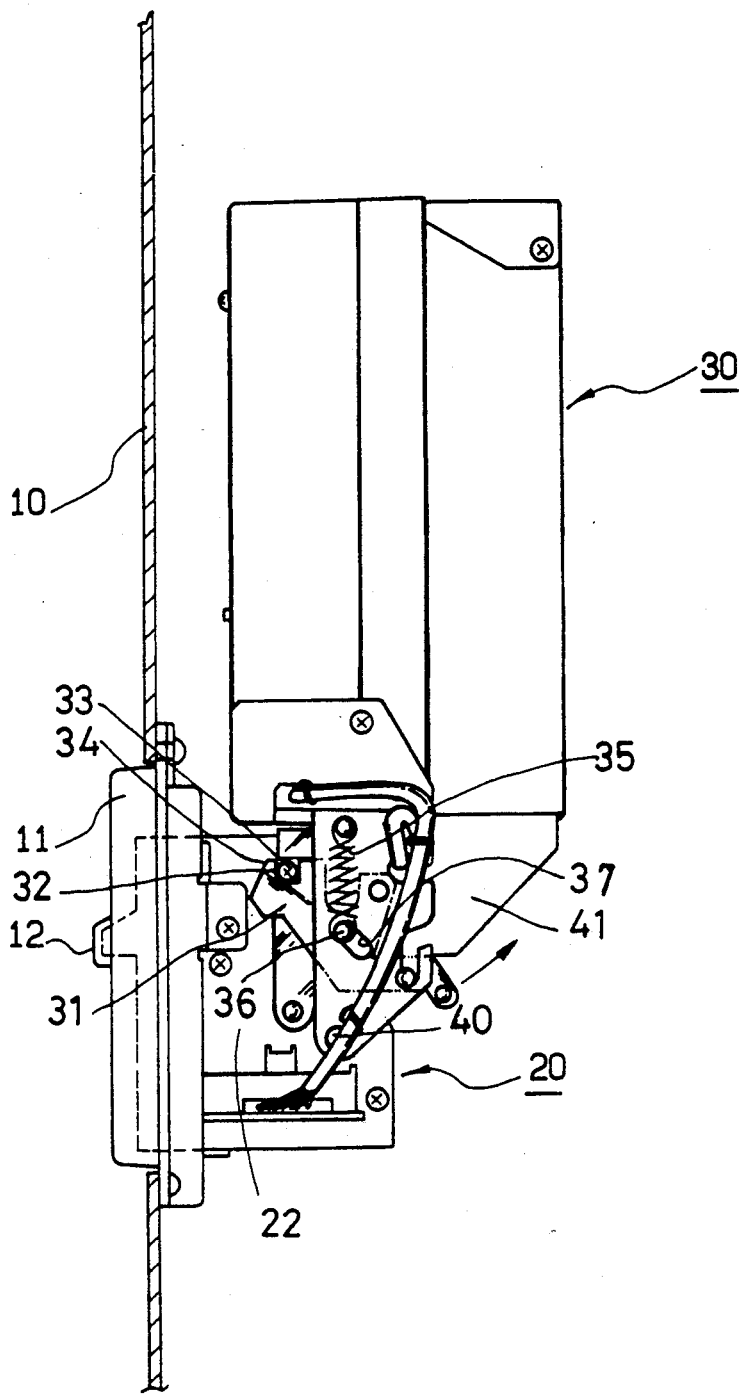
FIG. 2 is a side view of the apparatus with the stacker means in the operative position.

As apparent from FIGS. 1 and 2, the apparatus for currency validation according to the present invention is firmly secured to an inner surface of a door 10 in hinged connection to a box of the vending machine for exchange of bills for goods.

The apparatus comprises validator means 20 for identifying authenticity of a bill, and stacker means 30 for storing bills conveyed from the validator means 20 by a belt-pulley arrangement not shown because well known. The validator means 20 includes a lower portion 22 which has a fixing panel 11 firmly secured to an inner panel surface of the door 10 as a support by means of known fixing means, and an upper portion 23 in rotatable connection to the lower portion 22 by hinge means 24 so that the upper portion 23 may be moved between the closed position shown by full line in FIG. 3 and the opened position shown by dotted line. Defined between the lower and upper portions 22, 23 by the belt-pulley arrangement is a passageway 21 to guide a bill toward the stacker means 30 when the upper portion 23 is in the closed position away from the lower portion 22. The validator means 20 includes optical or magnetic sensors (not shown) for detecting physical features from the bill passing along the passageway 21 to identify the authenticity or denomination of the bill.

In this embodiment, the hinge means 24 includes a pair of curved slots 22*a* formed on opposite upper walls of the lower portion 22, and pins 23*a* protruded from side walls of the upper portion 23 so that the pins 23*a* pass through the curved slots 22*a*. These pins 23*a* may be threaded screws each with a head. Accordingly, the pins 23*a* may be moved along the curved slots 22*a* for arcuate movement between the closed and opened positions. Alternatively, the lower portion 22 may have pins engaged with curved slots formed at the upper portion 23. The curved slots 22 may be of a part of arc, ellipse or substantially L-shaped configuration.

The stacker means 30 is mounted on the lower portion 22 of the validator means 20, and a pair of brackets 41 secured to the stacker means 30 are rotatably connected to shafts 40 provided on opposite side walls of the lower portion 22. Accordingly, the stacker means 30 may be swiveled between the operative position shown in FIG. 2 wherein movement of the upper portion 23 to the opened position is prevented by the stacker means 30, and the rest position shown in FIG. 3 wherein the upper portion 23 is free to be rotated to the opened position. Thus, the upper portion 23 may be moved from the closed to the opened position after the stacker means 30 is rotated from the operative to the rest position. A lever 31 is rotatably mounted on one of the brackets 41 around a pin 36 received within an elongated hole 37 of the brackets 41. The lever 31 has a hook portion 32 formed at an end of the lever 31 for engagement with a pin 33 secured to the lower portion 22 to keep the stacker means 30 in the operative position. A spring 35 is provided to urge the hook portion 32 toward the pin 33. An inclined edge 34 is formed at the front end of the hook portion 32 and is in contact with the pin 33 when the stacker means 30 is rotated to the operative position, thereby causing the lever 31 to rotate in counterclockwise direction against resilient force of the spring 35 so that the hook portion 32 is engaged with the pin 33. When the other end of the lever 31 is pushed against the resilient force of the spring 35, engagement of the hook portion 32 is released from the pin 33.

Figure 3:
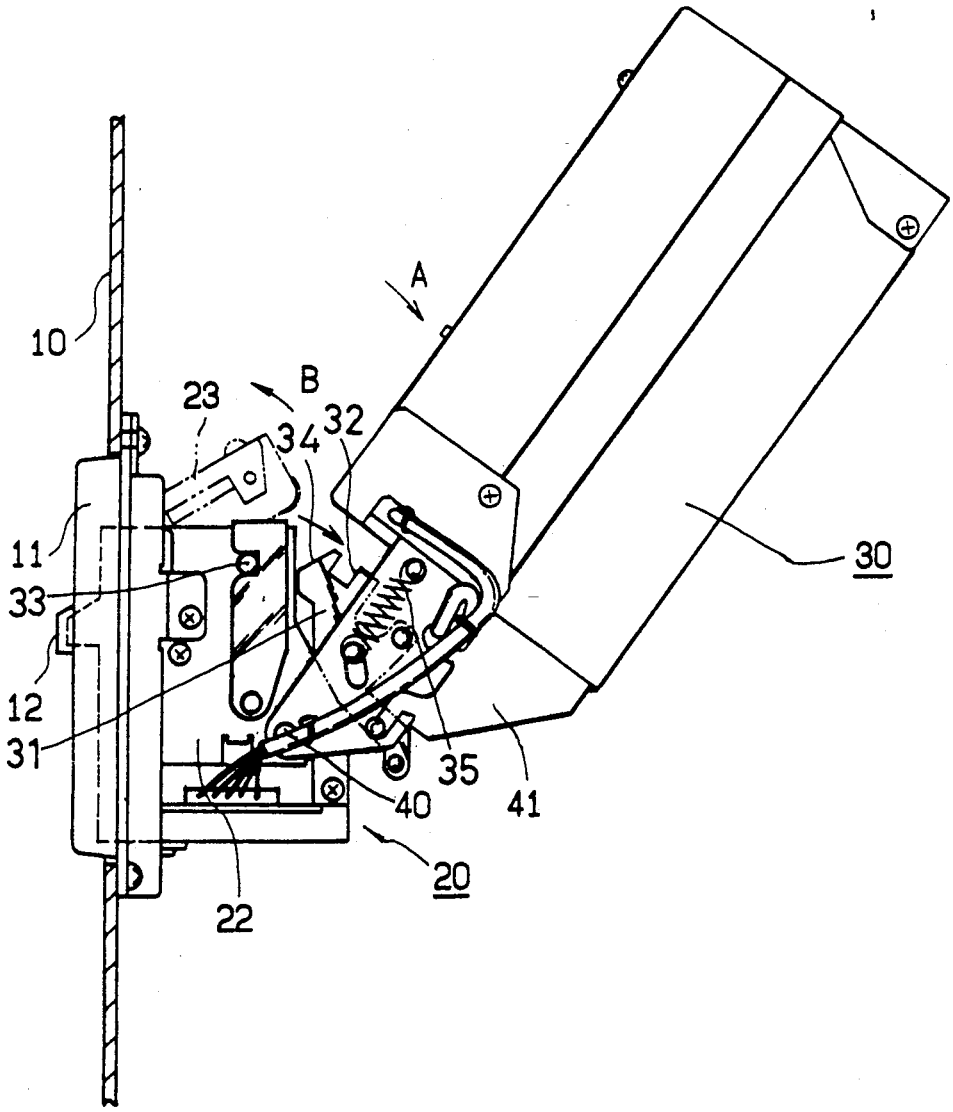
FIG. 3 is a side view of the apparatus with the stacker mean in the rest position.
Figure 4:
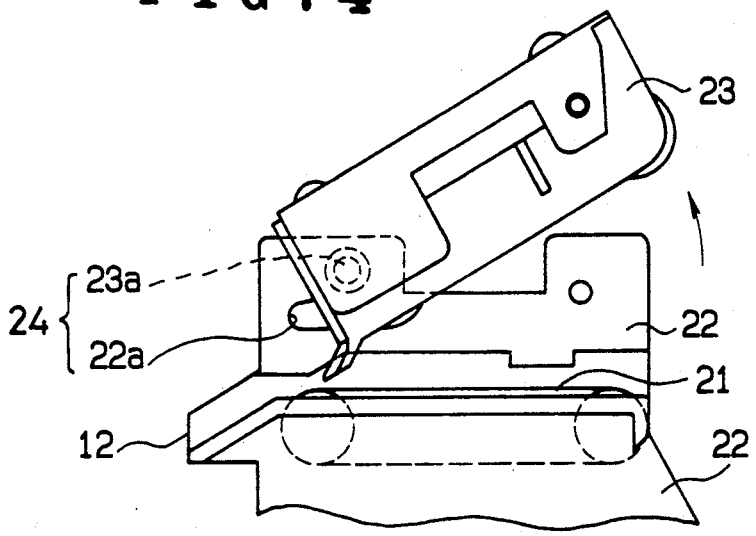
FIG. 4 is a side view of the validator means with the upper portion thereof in the opened position.
Figure 5:
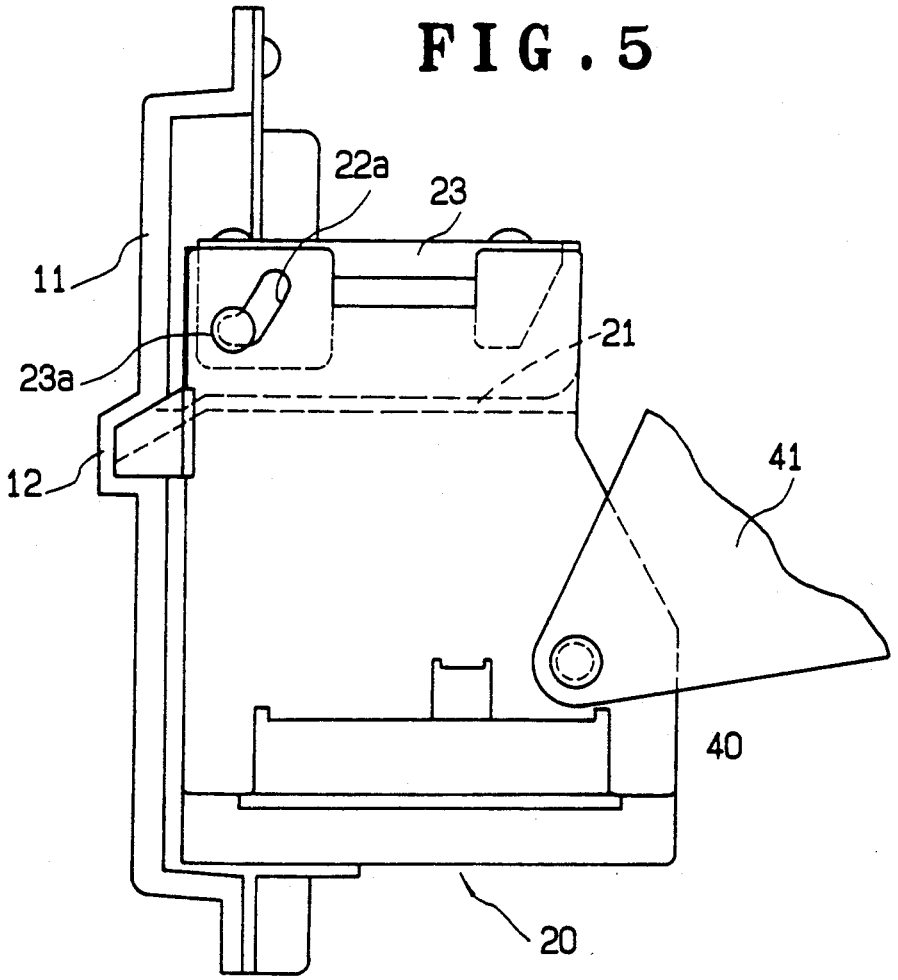
FIG. 5 is a side view of the validator means with the upper portion thereof in the closed position.

If a bill is jammed on the passageway in the validator means 20, the door 10 is opened and the stacker means 30 is rotated from the operative position of FIG. 2 to the rest position of FIG. 3. Then, the upper portion 23 is moved from the closed to the opened position in a direction shown by an arrow B of FIG. 3 with the arcuate movement of the pins 23*a*. Simultaneously, the front end of the upper portion 23 is moved along the curved slots 22*a* of the hinge means 24 and the rear end of the upper portion 23 is rotated upward. Due to the arcuate movement of the pins 23*a*, the upper portion 23 may smoothly be moved to the opened position without contact of the front end with the fixing panel 11 since the front portion of the upper portion 23 is rotated to the opened position away from the fixing panel 11. After the upper portion 23 is moved to the opened position, the jammed bill may be removed from the passageway 21. Similar operations may be carried out for inspection or repair to the apparatus.

As mentioned above, the apparatus according to the present invention eliminates time-consuming operation for disassembly of the apparatus when a bill is jammed in the validator means or upon inspection or repair to the apparatus.

What is claimed is:

1. An apparatus for currency validation comprising:

validator means for identifying authenticity of a bill, said validator means including a lower portion which has a fixing panel secured to an inner panel surface of a support, an upper portion in hinged connection to said lower portion for movement between opened and closed positions, and a belt-pulley arrangement positioned between said lower and upper portions for defining a passageway to guide a bill when said upper portion is in the closed position, said hinged connection including means permitting translation of the hinge axis during movement between said opened and closed positions; and stacker means positioned over said validator means and having a bracket in hinged connection to said lower portion of the validator means for rotation between operative and rest positions and for storing bills conveyed along the passageway by said belt-pulley arrangement of the validator means when said stacker means is in the operative position;

wherein said upper portion of the validator means may be moved from the closed to the opened position after the stacker means is moved from the operative to the rest position.

2. An apparatus for currency validation comprising:

validator means for identifying authenticity of a bill, said validator means including a lower portion which has a fixing panel secured to an inner panel surface of a support, an upper portion in hinged connection to said lower portion for movement between opened and closed positions, and a belt-pulley arrangement positioned between said lower and upper portions for defining a passageway to guide a bill when said upper portion is in the closed position; and stacker means positioned over said validator means and having a bracket in hinged connection to said lower portion of the validator means for rotation between operative and rest positions and for storing bills conveyed along the passageway by said belt-pulley arrangement of the validator means when said stacker means is in the operative position; and hinge means including a pair of curved slots formed in one of said upper and lower portions of the validator means, and pins secured to the other of said upper and lower portions in hinged connection with said slots for arcuate movement of a front end of the upper portion so that the upper portion may be moved to the opened position;

wherein said upper portion of the validator means may be moved from the closed to the opened position after the stacker means is moved from the operative to the rest position.

3. An apparatus for currency validation as defined in claim 2 wherein said upper portion of the validator means has the pins engaged with the curved slots formed at the lower portion of the validator.

4. An apparatus for currency validation as defined in claim 2 wherein said lower portion of the validator means has the pins engaged with the curved slots formed at the upper portion of the validator.

5. An apparatus for currency validation as defined in claim 2 further comprising shafts for rotatably mounting the stacker means on the lower portion of the validator means so that the stacker means may be swiveled around said shafts between the operative and rest positions, said upper portion of the validator means being prevented from the movement by the stacker means in the operative position.

6. An apparatus for currency validation as defined in claim 2 further comprising a lever releasably engaged with a pin to keep said stacker means in the operative position.

* * * * *